US006866571B1

(12) United States Patent
Held

(10) Patent No.: US 6,866,571 B1
(45) Date of Patent: Mar. 15, 2005

(54) BOLTLESS CARRIER RING/CARRIER PLATE ATTACHMENT ASSEMBLY

(75) Inventor: Ruediger Held, Minneapolis, MN (US)

(73) Assignee: Cypress Semiconductor Corp., San Jose, CA (US)

( * ) Notice: Subject to any disclaimer, the term of this patent is extended or adjusted under 35 U.S.C. 154(b) by 0 days.

(21) Appl. No.: 10/152,590

(22) Filed: May 21, 2002

(51) Int. Cl.[7] ..... B24B 41/06
(52) U.S. Cl. ..... 451/390; 451/285; 451/398
(58) Field of Search ..... 451/41, 285–288, 451/390, 398

(56) References Cited

U.S. PATENT DOCUMENTS 5,449,316 A * 9/1995 Strasbaugh ..... 451/289
5,584,746 A 12/1996 Tanaka et al.
5,584,751 A * 12/1996 Kobayashi et al. ..... 451/288
5,795,215 A * 8/1998 Guthrie et al. ..... 451/286
5,941,758 A 8/1999 Mack
5,948,204 A 9/1999 Maveety et al.
5,993,302 A * 11/1999 Chen et al. ..... 451/285
6,024,630 A 2/2000 Shendon et al.
6,068,548 A 5/2000 Vote et al.

* cited by examiner

*Primary Examiner*—Lee D Wilson
(74) *Attorney, Agent, or Firm*—Kevin L. Daffer; Mollie R. Lettang; Daffer McDaniel, LLP

(57) ABSTRACT

A polishing system is provided which includes an o-ring adapted to couple a carrier ring to a carrier plate. In some embodiments, one component may include a groove with which to receive the o-ring and the other component may be substantially absent of a groove adapted to receive an o-ring. Alternatively, both components may include a groove with which to receive the o-ring. Consequently, a semiconductor polishing system component comprising a notch adapted to receive an o-ring is also provided herein. In particular, the semiconductor polishing system component may be adapted to couple to another semiconductor polishing system component by use of the o-ring. In addition, a method for assembling a semiconductor polishing system is contemplated herein, which includes positioning a first component of the semiconductor polishing system against a portion of an o-ring protruding from a groove arranged within a second component of the semiconductor polishing system.

20 Claims, 3 Drawing Sheets

BOLTLESS CARRIER RING/CARRIER PLATE ATTACHMENT ASSEMBLY

BACKGROUND OF THE INVENTION

1. Field of the Invention

This invention relates to semiconductor device manufacturing, and more particularly, to an improved method and system for polishing a semiconductor topography.

2. Description of the Related Art

The following descriptions and examples are given as background only.

Frequently, upper surfaces of a semiconductor topography are polished during the fabrication of a device to fabricate layers and structures with planar surfaces. For example, elevational disparities of a dielectric layer used to form an interlevel dielectric layer or shallow isolation trench regions may be reduced by polishing the dielectric layer. In some cases, additional layers and structures such as, contact structures, additional dielectric layers, and/or metallization layers may be formed above such a polished layer or structure. For instance, in an embodiment in which the polished dielectric layer is an interlevel dielectric, a contact opening may be formed within the dielectric layer and subsequently filled with a layer of conductive material. Moreover, the layer of conductive material may be formed within the contact opening and on an upper surface of the polished dielectric layer. Consequently, the layer of conductive material may be polished such that an upper surface of the contact structure may be relatively level with an upper surface of the dielectric layer. In addition, since the polished upper surface of the dielectric layer is planar, the contact structure may have uniform vertical and lateral dimensions. Consequently, the polished upper surface of lower layers and/or structures may facilitate the formation of upper layers and structures having dimensions, which are approximately equal to the design specifications of the semiconductor device.

Forming a substantially planar upper surface of layers and structures may play an important role in the functionality of a semiconductor device. For example, problems with step coverage may arise when a material is deposited over a topological surface having elevationally raised and recessed regions. Step coverage is defined as a measure of how well a film conforms over an underlying step and is expressed by the ratio of the minimum thickness of a film as it crosses a step to the nominal thickness of the film over horizontal regions. Furthermore, substantially planar surfaces may become increasingly important as the feature sizes of semiconductor devices are reduced, since the depth of focus required to pattern an upper surface of a semiconductor topography may increase with reductions in feature size. In addition, if a topography is non-planar, the patterned image may be distorted and the intended structure may not be formed to the specifications of the device. In particular, correctly patterning layers upon a topological surface containing "hill" or "valley" areas may be difficult using optical lithography since all parts of the topography must be within the depth of focus of the lithography system.

As mentioned above, elevational fluctuations in the surface of a semiconductor topography may be removed by polishing the topography. A conventional polishing process may involve placing a semiconductor wafer against a carrier plate, which is surrounded by a carrier ring adapted to prevent movement of the wafer during polishing. The wafer may be pressed face-down toward an underlying polishing pad. During the polishing process, the polishing pad and/or the wafer carrier may be set in motion as the wafer is forced against the pad. In some embodiments, an abrasive, fluid-based chemical suspension, often referred to as a "slurry," may be deposited onto the surface of the polishing pad. The slurry may fill the space between the polishing pad and the wafer surface such that a chemical in the slurry may react with the surface material being polished. In addition, the movement of the polishing pad and/or wafer relative to each other may cause abrasive particles entrained within the slurry to physically strip the reacted surface material from the wafer. Alternatively, the slurry may be substantially absent of particulate matter and/or chemicals. In either embodiment, the pad itself may physically remove some material from the surface of the semiconductor topography.

Unfortunately, conventional polishing processes may not form a substantially planar surface across an entire semiconductor topography. In particular, a semiconductor topography polished by a conventional process may still have substantial elevational disparities, particularly at an edge of the topography. For instance, the thickness variation of a structure at the edge of a polished semiconductor topography may be greater than the thickness variation of a similar structure residing within an inner portion of the topography. Furthermore, the average thickness of the structure at the edge of a polished semiconductor topography may be greater than the average thickness of the similar structure residing within the inner portion of the topography. In either embodiment, such elevational disparities may inhibit the formation of functional semiconductor devices on a portion of the semiconductor topography. For example, a thick region at the outer edge of the semiconductor topography may form semiconductor devices with dimensions, which deviate significantly from design specifications. In this manner, acceptable devices may not be formed within an area of the semiconductor topography having such elevational disparities, thereby reducing the number of devices which may be formed on the semiconductor topography. As such, the presence of such elevational disparities on a semiconductor topography may reduce manufacturing yield and may increase production costs per semiconductor device.

In some embodiments, the assembly of the wafer carrier of the polishing system may contribute to the formation of elevational disparities across the semiconductor topography. In particular, the manner in which the carrier ring is coupled to the carrier plate may contribute to the formation of elevational disparities across the semiconductor topography. In conventional polishing processes, bolts may be used to couple the carrier ring to the carrier plate. In particular, bolts may be screwed into aligned openings of the carrier plate and carrier ring. Frequently, however, the bolts may be over-torqued, warping the carrier ring and/or carrier plate and resulting in a poor attachment of the two components. Such a poor attachment may allow regions of the wafer to be brought closer or farther away from the polishing pad. Such a "toggling" of the wafer may cause a variation of the polishing process, resulting in elevational disparities across the wafer.

Another problem associated with the warping of the carrier ring and/or carrier plate is that the protrusion of the wafer extending from the carrier ring toward the polishing pad may undesirably deviate from its specified dimension. Typically, it is beneficial for the wafer to extend from the carrier ring by a certain amount such that the carrier ring does not interfere with the polishing process (i.e., such that the carrier ring does not come into contact with the polishing pad during the polishing process). However, warping of the carrier ring and/or carrier plate may cause the protrusion of the wafer to change, compromising the functionality of the polishing system. Consequently, shims are sometimes placed between the carrier ring and carrier plate to compensate for such a change in the carrier ring thickness. Unfortunately, the assembly and reassembly of a wafer carrier with shims may be time consuming and therefore, costly. In particular, the protrusion of a wafer extending from the carrier ring may have to be measured after each wafer carrier assembly to insure that the shims position the wafer within the process specifications of the polishing system. In addition, such a protrusion measurement is typically measured manually and therefore, may introduce an increase in process variation due to human-error occurrences.

Accordingly, it would be advantageous to develop a polishing system, which does not require the use of shims to insure a protrusion of a wafer extending from a carrier ring is within the process specifications of a polishing process. In particular, it would be beneficial to develop a polishing system, which yields a protrusion within process specifications upon coupling a carrier ring to a carrier plate. In addition, it would be advantageous to develop an improved method for coupling a carrier ring to a carrier plate. In particular, it would be beneficial to develop a polishing system, which does not cause the carrier ring and/or carrier plate to be warped.

SUMMARY OF THE INVENTION

The problems outlined above may be in large part addressed by a polishing system, which includes an o-ring adapted to couple a carrier ring to a carrier plate. In particular, the carrier ring and carrier plate may each include a portion adapted to contact the o-ring upon coupling the carrier ring to the carrier plate. In some embodiments, the portion of the carrier plate may include a groove with which to receive the o-ring and the portion of the carrier ring may be substantially absent of a groove adapted to receive an o-ring. Alternatively, the portion of the carrier ring may include a groove adapted to receive the o-ring and the portion of the carrier plate may be substantially absent of a groove with which to receive an o-ring. In yet other embodiments, both portions of the carrier ring and carrier plate may include a groove with which to receive the o-ring. Consequently, a semiconductor polishing system component comprising a notch adapted to receive an o-ring is provided herein. In particular, the semiconductor polishing system component may be adapted to couple to another semiconductor polishing system component by use of the o-ring. In some cases, the semiconductor polishing system component may be a carrier plate. In other embodiments, the semiconductor polishing system component is a carrier ring.

In any embodiment, the carrier plate of the polishing system may be adapted to receive a semiconductor wafer and the carrier ring may be adapted to hold the semiconductor wafer relative to the carrier plate. In some embodiments, the carrier ring and the carrier plate may be dimensionally adapted to protrude a portion of the semiconductor wafer within approximately 0.001 inches of a predetermined value. For example, in some cases, the carrier ring may include a thickness tolerance between approximately 0.0001 inches and approximately 0.001 inches. In particular, a thickness variation across the entire width of the carrier ring may be between approximately 0.0001 inches and approximately 0.001 inches. In addition, the carrier plate may include a thickness tolerance between approximately 0.0001 inches and approximately 0.001 inches. For example, the carrier plate may include a section with a thickness variation between approximately 0.0001 inches and approximately 0.001 inches across the entire diameter of the section. In other embodiments, the narrow thickness variation may extend across the entirety of the carrier plate.

Furthermore, the polishing system described herein may be adapted to produce a substantially planar surface across an entirety of the semiconductor wafer. In particular, the polishing system may be adapted to produce a substantially planar surface in regions comprising the center of the wafer and regions extending from an outer edge of the semiconductor wafer. More specifically, the polishing system may be adapted to produce a substantially planar surface in a region extending less than approximately 25 mm from an outer edge of the semiconductor wafer, or more specifically less than approximately 8 mm from the outer edge of the semiconductor wafer or less than approximately 5 mm from the outer edge of the semiconductor wafer. In this manner, a substantially planar surface may be fabricated which includes a structure with a thickness that differs by less than approximately 10% of a thickness of a similar structure arranged within the center of the semiconductor wafer.

A method for assembling a semiconductor polishing system is also contemplated herein. In particular, the method may include positioning a first component of the semiconductor polishing system against a portion of an o-ring protruding from a groove arranged within a second component of the semiconductor polishing system. In some embodiments, the method may include positioning the first component such that the protrusion of the o-ring is received by a groove arranged within the first component. In other embodiments, the method may include securing a portion of the first component that is substantially absent of a groove against the protrusion of the o-ring. In either embodiment, the protrusion of the o-ring may extend from a sidewall of the second component by a distance between approximately 0.0001 inches and approximately 0.01 inches. In addition or alternatively, the method may include placing a semiconductor wafer against one of the first or second components directly after positioning the first component against the o-ring. In this manner, positioning the first component against the o-ring may secure the first component to the second component, without the need for further steps to couple of the components. In other words, the method may not require any other process steps for securing the first component to the second component.

There may be several advantages to assembling a semiconductor polishing system in the manner described herein. In particular, coupling a carrier ring to a carrier plate without the use of bolts may prevent the carrier ring and/or carrier plate from being warped. As a result, the polishing system described herein may be adapted to form a substantially planar upper surface upon a semiconductor topography, particularly at the outer edge of the semiconductor topography. For example, a functional semiconductor device may be formed in a region extending less than approximately 25 mm from the outer edge of a wafer or more specifically, approximately 8 mm from the outer edge of the wafer. In some cases, the polishing system described herein may allow semiconductor devices to be formed in a region of the topography extending less than approximately 5 mm from the outer edge of the topography. The formation of functional semiconductor devices within such a relatively close vicinity of the outer edge of the substrate may allow for an increase in the number of devices that may be formed upon a substrate. Such an increase in semiconductor device formation upon a substrate may increase manufacturing yield and may reduce production costs per semiconductor device.

In addition, the carrier ring and carrier plate may be dimensionally adapted to protrude a portion of the semiconductor wafer within approximately 0.001 inches of a predetermined value. As a result, shims may not have to be used to insure that the wafer protrudes from the carrier at such a predetermined distance. Accordingly, time and money spent for assembling polishing systems may be reduced. In addition, the step of measuring the wafer protrusion after each wafer carrier assembly may be eliminated, thereby saving assembly time.

BRIEF DESCRIPTION OF THE DRAWINGS

Other objects and advantages of the invention will become apparent upon reading the following detailed description and upon reference to the accompanying drawings in which.

Figure 1:
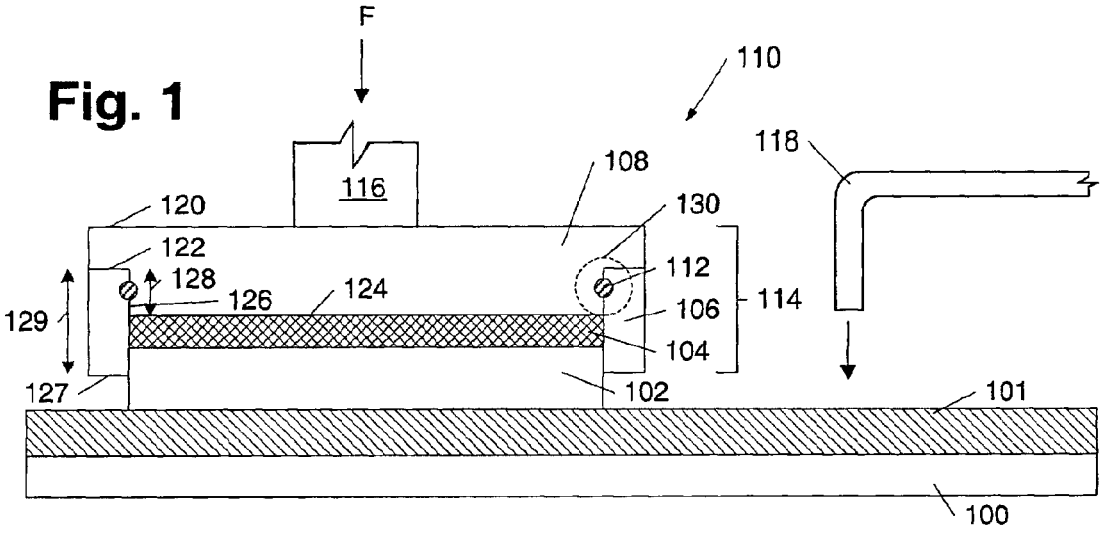
FIG. 1 depicts a partial cross-sectional view of a polishing system including an o-ring interposed between a carrier plate and a carrier ring.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Turning to the drawings, an exemplary embodiment of a polishing system is illustrated in FIG. 1. In particular, FIG. 1 depicts a partial cross-sectional view of polishing system 110 adapted to polish semiconductor topography 102. In general, the upper surface of semiconductor topography 102 (i.e., the side of semiconductor topography 102 facing downward for polishing in FIG. 1) may be polished by polishing system 110 in an effort to form a substantially planar upper surface, reduce the thickness of an upper layer of the topography, and/or remove surface irregularities of semiconductor topography 102. In some cases, semiconductor topography 102 may be a semiconductor substrate. Alternatively, semiconductor topography 102 may include one or more layers, such as dielectric or metallization layers, formed above a semiconductor substrate. In another embodiment, semiconductor topography 102 may additionally or alternatively include one or more structures, such as gate structures, contact structures, and local interconnect wires. In yet another embodiment, semiconductor topography 102 may additionally or alternatively include diffusion regions and/or isolation regions formed within a semiconductor substrate. In any case, semiconductor topography 102 may form a substantially planar or nonplanar upper surface.

In general, the process used to polish semiconductor topography 102 may involve placing the topography within wafer carrier 114 in order to hold semiconductor topography 102 relative to underlying polishing pad 101. Polishing pad 101 may be made of various substances, depending on the material being polished. For example, a popular polishing pad medium includes polyurethane or polyurethane-impregnated polyester felts. In some cases, polishing pad 101 may be relatively flexible such that the pad may follow the contour of semiconductor topography 102. Alternatively, polishing pad 101 may be relatively rigid such that the pad does not follow the contour of semiconductor topography 102. Consequently, the polishing process, in such an embodiment, may be referred to as a "fixed abrasive polishing". In some embodiments, polishing pad 101 may lie upon or may be attached to backing structure 100. Backing structure 100 may include a fixed structure, rotational table or platen, or a belt, for example. As such, polishing pad 101 may be adapted to move relative to semiconductor topography 102 in some embodiments. In addition or alternatively, wafer carrier 114 may be adapted to move semiconductor topography 102 relative to polishing pad 101. In either embodiment, downward force F may be applied to shaft 116 to press semiconductor topography 102 against polishing pad 101 to begin the polishing process.

In some cases, a solution may be deposited from conduit 118 upon the surface of polishing pad 101 to remove residual particulate matter or chemically react with semiconductor topography 102 during the polishing process. In some cases, the solution may include an abrasive, fluid-based chemical, often referred to as a "slurry." The slurry may initiate the polishing process by chemically reacting with the surface material being polished. The movement of polishing pad 101 and/or semiconductor topography 102 may cause abrasive particles entrained within the slurry to physically strip the reacted surface material from the semiconductor topography. The polishing process in such an embodiment may be referred to as "chemical-mechanical polishing" since the process may employ a combination of chemical stripping and mechanical polishing. Alternatively, the solution deposited from conduit 118 may be substantially absent of abrasive particles and/or strong acids or bases. In yet other embodiments, conduit 118 may be additionally or alternatively used to deposit a post-polishing cleaning solution to remove residual slurry particles from the surface of the polished topography after the polishing process.

Wafer carrier 114 may include carrier backing film 104, carrier plate 108, carrier ring 106, and o-ring 112. As stated above, wafer carrier 114 may be adapted to hold semiconductor topography 102. In particular, backing film 104 may be attached to carrier plate 108 in a manner with which to receive the backside of semiconductor topography 102. Backing film 104 may include a compressive material such that semiconductor topography 102 may be gently received against carrier plate 108. In addition, carrier ring 106 may be positioned about carrier plate 108 to prevent the side-to-side movement of semiconductor topography 102. In particular, carrier ring 106 may be coupled to carrier plate 108 by o-ring 112. In general, carrier plate 108 may have circular shape having a diameter similar to the diameter of semiconductor topography 20. Alternatively, carrier plate 108 may have a diameter smaller or larger than the diameter of semiconductor topography 20. In either embodiment, carrier ring 106 may be an annular ring adapted to couple to the circumference of carrier plate 108. In addition, o-ring 112 may be an annular ring adapted to secure the coupling of carrier ring 106 and carrier plate 108.

In some embodiments, carrier plate 108 may include an elongated portion and a shortened portion as shown in FIG. 1. In particular, carrier plate 108 may include an elongated lateral portion bounded by upper surface 120 and lower lip surface 122. In addition, carrier plate 108 may include a shortened lateral portion bounded by lower surface 124 and the lower boundary of the elongated portion. In some cases, the orientation of carrier plate 108 may be configured such that semiconductor topography 102 may be received against the shortened portion of carrier plate 108. As such, the vacant region underlying lower lip surface 122 in such an embodiment may allow carrier ring 106 to be positioned about carrier plate 108 as shown in FIG. 1. In particular, carrier ring 106 may be positioned against lower lip surface 122 of the elongated portion and against lateral surface 126 of the shortened portion. In some embodiments, the diameter variation between the elongated portion and the shortened portion may be approximately similar to the width of carrier ring 106 as shown in FIG. 1. Alternatively, the diameter variation between the elongated portion and the shortened portion may be smaller or larger than the width of carrier ring 106.

In other embodiments, the orientation of carrier plate 108 may be configured such that semiconductor topography 102 may be received against the elongated portion of carrier plate 108. In such an embodiment, carrier ring 106 may be configured to be positioned about the elongated portion of carrier plate 108. In either case, carrier ring 106 may be further configured such that both elongated and shortened portions of carrier plate 108 are surrounded. In general, other configurations of carrier plates used in the semiconductor fabrication industry may also be integrated within a polishing system as described herein. As such, the configuration of carrier plate 108 is not restricted to the illustration included in FIG. 1. For example, in some embodiments, carrier plate 108 may include a single portion of uniform diameter with which carrier ring 106 may come into contact. In such an embodiment, carrier plate 108 may not include an elongated portion with which to receive semiconductor topography 102.

In any embodiment, polishing system 10 may be adapted to protrude a portion of semiconductor topography 102 from lower surface 127 of carrier ring 106 upon coupling carrier ring 106 to carrier plate 108. Such a protrusion is preferably large enough to prevent carrier ring 106 from contacting polishing pad 101 during the polishing process, but small enough such that semiconductor topography 102 may be held without movement. As such, in some embodiments, the dimensional specification of the protrusion may include a relatively small tolerance. For example, a protrusion of a semiconductor topography may be specified with a tolerance of approximately 10% of the specified target dimension. As such, in an embodiment in which the target dimension of a protrusion is specified to be approximately 0.01 inches, the protrusion of the semiconductor topography may vary between approximately 0.009 inches and approximately 0.011 inches. Larger or smaller target values and/or tolerances, however, may be specified depending on the process parameters of the polishing process.

As such, carrier plate 108 and carrier ring 106 may be dimensionally adapted to protrude a portion of semiconductor topography 102 within a certain tolerance of a target dimensional value. In particular, carrier plate 108 and carrier ring 106 may be dimensionally adapted to protrude a portion of semiconductor topography 102 within approximately 0.001 inches of a predetermined value, for example. In other embodiments, however, carrier plate 108 and carrier ring 106 may be dimensionally adapted to protrude a portion of semiconductor topography 102 within a larger or a smaller tolerance of a predetermined value, depending on the process parameters of the polishing process.

In some embodiments, the thickness tolerance of carrier ring 106 and carrier plate 108 may, in particular, lend to the adaptation of the protrusion of semiconductor topography 102 being within a tolerance of a predetermined value. In particular, the thickness tolerance of the carrier ring 106 and the thickness tolerance of the portion of carrier plate 108 configured to laterally contact carrier ring 106 upon coupling may lend to such an adaptation. For example, the tolerances of thickness 129 of carrier ring 106 and thickness 128 of the shortened portion of carrier plate 108 as shown in FIG. 1 may lend to the adaptation of the protrusion of semiconductor topography 102 being within a tolerance of a predetermined value. For instance, carrier ring 106 may include a thickness tolerance between approximately 0.0001 inches and approximately 0.001 inches, for example. In addition or alternatively, carrier plate 108 may include a thickness tolerance between approximately 0.0001 inches and approximately 0.001 inches. Larger or smaller tolerances for carrier ring 106 and carrier plate 108 may be appropriate, however, depending on the process parameters of the polishing process.

Figure 2A:
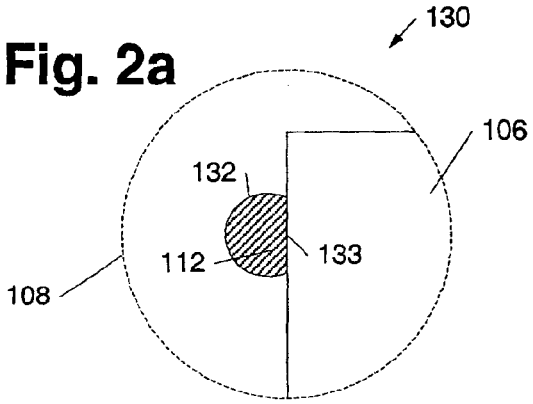
FIG. 2*a* depicts a partial cross-sectional view of a magnified portion of the polishing system of FIG. 1 with the o-ring positioned within a groove of the carrier plate.
Figure 2B:
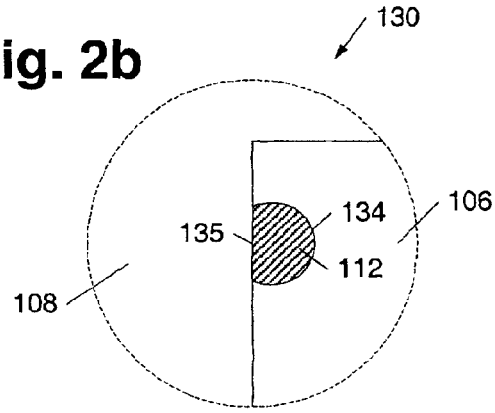
FIG. 2*b* depicts a partial cross-sectional view of a magnified portion of the polishing system of FIG. 1, in an alternative embodiment, with the o-ring positioned within a groove of the carrier ring.
Figure 2C:
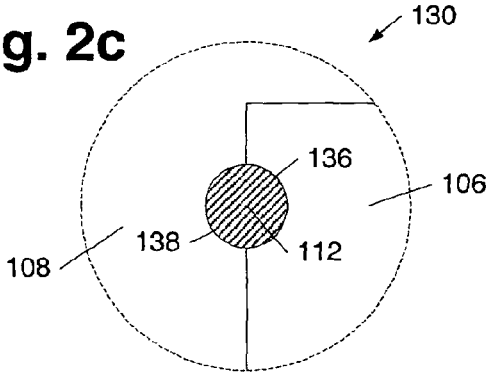
FIG. 2*c* depicts a partial cross-sectional view of a magnified portion of the polishing system of FIG. 1, in an alternative embodiment, with the o-ring positioned within grooves of the carrier plate and the carrier ring.

As stated above, o-ring 112 may be adapted to couple carrier ring 106 to carrier plate 108. Consequently, carrier plate 108 and carrier ring 106 may each include a portion adapted to contact o-ring 112 upon coupling the components together. Although FIG. 1 illustrates o-ring 112 approximately equally interposed between carrier plate 108 and carrier ring 106, the orientation of o-ring 112 with respect to carrier plate 108 and carrier ring 106 may vary as shown in FIGS. 2*a*–2*c*. In particular, FIGS. 2*a*–2*c* illustrate different exemplary embodiments of the coupled configuration of carrier plate 108 and carrier 106 by magnifying portion 132 of polishing system 110. However, the configuration of carrier plate 108 and carrier ring 106 may differ from those embodiments shown in FIGS. 2*a*–2*c*. In particular, carrier plate 108 and carrier ring 106 may be configured in any manner in which o-ring 112 may be securely interposed between the two components.

In one embodiment, carrier plate 108 may include groove 132 adapted to receive o-ring 112 and carrier ring 106 may be substantially absent of a groove adapted to receive an o-ring as shown in FIG. 2*a*. More specifically, the portion of carrier ring 106 in contact with o-ring 112 may be substantially absent of a groove with which to receive an o-ring. In such an embodiment, o-ring 112 may be positioned within groove 132 prior to positioning carrier ring 106 around carrier plate 128. In most cases, o-ring 112 and groove 132 may be adapted to protrude a portion of o-ring 112 beyond the sidewall of carrier plate 108. In particular, o-ring 112 and groove 132 may be sized such that a portion of o-ring 112 protrudes exterior from groove 132. Particular size adaptations for such a protrusion are described in more detail below with reference to the description o-ring 112 and the grooves within carrier ring 106 and carrier plate 108. In general, however, the protrusion of o-ring 112 should be small enough to allow the components to be securely coupled and yet large enough to prevent carrier ring 106 and carrier plate 108 from moving relative to each other after being coupled.

After o-ring 112 is received within groove 132, carrier ring 106 may be positioned around carrier plate 108 such that contact to o-ring 112 and lower surface 122 is made. Alternatively, carrier ring 106 may be positioned around carrier plate 108 without contacting lower surface 122. In either embodiment, securing carrier ring 106 against carrier plate 108 may include compressing the protruding portion of o-ring 112. Adaptations of o-ring 112 for such a compression is described in more detail below in reference to the description of the material composition of o-ring 112. Consequently, carrier ring 106 may be brought into contact with lateral surface 126 upon coupling the carrier ring to carrier plate 108.

In an alternative embodiment, carrier ring 106 may include groove 134 adapted to receive o-ring 112 and carrier plate 108 may be substantially absent of a groove with which to receive an o-ring as shown in FIG. 2*b*. More specifically, the portion of carrier plate 108 in contact with o-ring 112 may be substantially absent of a groove with which to receive an o-ring. Such a configuration may be a mirror image of the embodiment illustrated in FIG. 2*a*. As such, o-ring 112 and groove 134 may be adapted to protrude a portion of o-ring 112 beyond the sidewall of carrier ring 106. In particular, o-ring 112 and groove 134 may be sized such that a portion of o-ring 112 protrudes exterior from groove 134. In addition, securing carrier ring 106 against carrier plate 108 may include compressing the protruding portion of o-ring 112. Consequently, carrier ring 106 may be brought into contact with lateral surface 126 upon coupling the carrier ring to carrier plate 108.

In yet other embodiments and as shown in FIG. 2*c*, both carrier ring 106 and carrier plate 108 may include grooves 136 and 138 with which to receive o-ring 112, respectively. In such an embodiment, o-ring 112 may be placed on either of carrier ring 106 or carrier plate 108 prior to coupling the components together. Consequently, o-ring 112 and grooves 136 and 138 may be adapted to protrude a portion of o-ring 112 from the sidewall of the polishing component in which it was received. In some embodiments, grooves 136 and 138 may be approximately the same size. Alternatively, grooves 136 and 138 may be different sizes. Subsequent to positioning o-ring 112 within one or grooves 136 or 138, the polishing component not including o-ring 112 may be positioned relative to the polishing component including o-ring 112. Such a coupling configuration may include positioning the polishing components until o-ring 112 is received within both of grooves 136 and 138. In such an embodiment, o-ring 112 may be recessed upon initial contact with the polishing component not including o-ring 112. However, o-ring 112 may return to its original shape after being received by the respective groove of the component.

As stated above, the size of o-ring 112 and the grooves within carrier ring 106 and carrier plate 108 may be adapted to protrude a portion of o-ring 112 from the sidewall of the component in which it is received. In addition, the size of o-ring 112 and the grooves within carrier ring 106 and carrier plate 108 may be optimized for such a secure coupling of the two components. For example, in some embodiments, o-ring 112 and the groove/s within carrier plate 108 and/or carrier ring 106 may be sized such that less than approximately 1% of the width of o-ring 112 protrudes beyond the sidewall of one of the components. For instance, o-ring 112 may have a width of approximately 0.25 inches with an inner diameter of approximately 7.5 inches and an outer diameter of approximately 7.75 inches. Such an o-ring size may be referred to as size "264" using standard o-ring sizing references. In such an embodiment, the protrusion of o-ring 112 extending beyond the sidewall of the component in which it is received may be between approximately 0.0001 inches and approximately 0.01 inches. More specifically, the protrusion of o-ring 112 extending beyond the sidewall of the component in which it is received may be approximately 0.005 inches in such an embodiment. Larger or smaller o-ring protrusions may be appropriate, however, depending on the size of the polishing components. In addition, larger or smaller sizes of o-rings 112 may be used, depending of the size of the polishing components.

Similarly, the grooves within carrier plate 108 and/or carrier ring 106 may be sized to accommodate such a size of o-ring 112. In particular, the grooves within carrier plate 108 and/or carrier ring 106 may include a height of approximately 0.25 inches, but may include a width of less than approximately 0.25 inches such that a portion of o-ring 112 may protrude from such a groove. Larger or smaller grooves within carrier plate 108 and/or carrier ring 106 may be used, however, depending on the size of the polishing components. The height of a groove, as used herein may refer to the dimension of the groove along the vertical orientation of the component in which it resides. The width on a groove, on the other hand, may refer to the dimension of the groove along the horizontal orientation of the component in which it resides.

In addition to the adaptation of the size of o-ring 112, the material of o-ring 112 may be adapted to secure carrier ring 106 to carrier plate 108. In particular, o-ring 112 may include a material adapted to compress such that carrier ring 106 may be coupled to carrier plate 108. More specifically, o-ring 112 may include a material adapted compress such that carrier ring 106 may be coupled to lateral surface 126. Moreover, such a material may be further adapted to hold carrier ring 106 in such a position. Furthermore, o-ring 112 may include a material with ample resiliency. In particular, o-ring 112 may include a material adapted to return to its original shape after being compressed. Such a characteristic may be particularly advantageous in embodiments in which both carrier plate 108 and carrier ring 106 include a groove with which to receive o-ring 112 as shown in FIG. 2*c*. In this manner, o-ring 112 may be compressed while carrier ring 106, for example, slides over lateral surface 124 and may return to its original shape upon being received by groove 136. A further explanation of the assembly of a wafer assembly is described an illustrated in FIG. 3 below. Consequently, o-ring 112 may be composed of an elastomeric material, such as chloroprene rubber, styrene-butadiene, acrylonitrile-butadiene, ethylene propylene rubber, and fluorocarbon. Other o-ring materials may be used as well, depending on the polishing solution used and the materials of carrier plate 108 and carrier ring 106.

Figure 3:
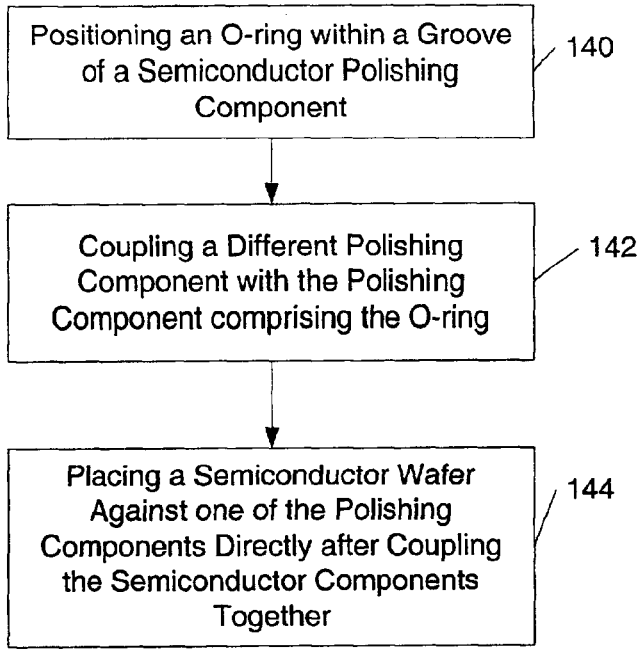
FIG. 3 depicts a flow chart for the assembling a wafer carrier.

FIG. 3 illustrates a flowchart of a method for assembling a wafer carrier. In particular, a method for assembling a wafer carrier may include step 140, which includes positioning an o-ring within a groove of a semiconductor polishing component. In some embodiments, the semiconductor polishing component may be a carrier plate. In other embodiments, the semiconductor polishing component may be a carrier ring. In either embodiment, the method may further include coupling a different semiconductor polishing component with the semiconductor polishing component comprising the o-ring as shown in step 142. In particular, step 142 may include positioning the different semiconductor polishing component against a portion of the o-ring protruding from the semiconductor polishing component in which the o-ring resides. Such a positioning step may include sliding the different semiconductor polishing component across a surface of the semiconductor polishing component comprising the o-ring until the components are securely coupled to each other. Alternatively, the semiconductor polishing component comprising the o-ring may be slid across a surface of the different semiconductor polishing component until the components are securely coupled to each other. As such, in either embodiment, a carrier ring may be slid across a surface of a carrier plate or the carrier plate may be slid across a surface of the carrier ring.

In some embodiments, the different semiconductor polishing component may also include a groove with which to receive the o-ring. In this manner, the o-ring may be received by grooves of both semiconductor polishing components upon being securely coupled to each other. In other embodiments, the portion of the different semiconductor polishing component secured against the o-ring may be substantially absent of a groove adapted to receive the o-ring. In either embodiment, the method may further include step 144 in which a semiconductor wafer is place against one of the polishing components directly after positioning the two semiconductor polishing components together. In this manner, positioning the different semiconductor polishing component against the o-ring may secure the two components together, without the need for further steps to couple of the components. In other words, the method may not require any other process steps for securing the first component to the second component.

In addition to providing a secure wafer carrier assembly and a wafer protrusion within a tolerance of a predetermined value, the polishing system described herein may produce a substantially planar surface across a semiconductor topography. In particular, the polishing system may be adapted to produce a substantially planar surface in regions comprising the center of a polished topography and regions extending from an outer edge of a polished semiconductor topography. More specifically, the polishing system described herein may be adapted to produce a substantially planar surface in a region extending less than approximately 25 mm from an outer edge of the semiconductor wafer, or more specifically less than approximately 8 mm from the outer edge of the semiconductor wafer. In some embodiments, the polishing system may be adapted to produce a substantially planar surface in a region extending less than approximately 5 mm from the outer edge of the semiconductor wafer. Consequently, a substantially planar surface may be fabricated which includes a structure with a thickness that differs by less than approximately 10% of a thickness of a similar structure arranged within the center of the semiconductor topography.

Figure 4:
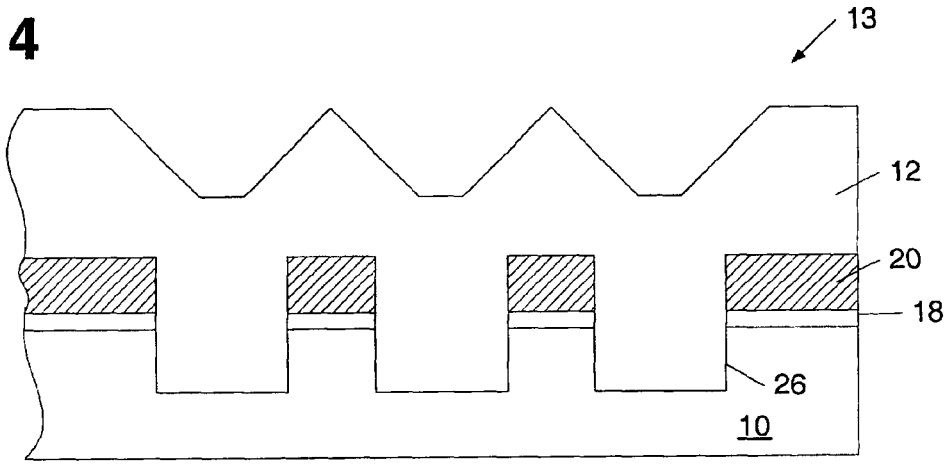
FIG. 4 depicts a partial cross-sectional view of a semiconductor topography in which a fill layer is formed above a plurality of layers.
Figure 5:
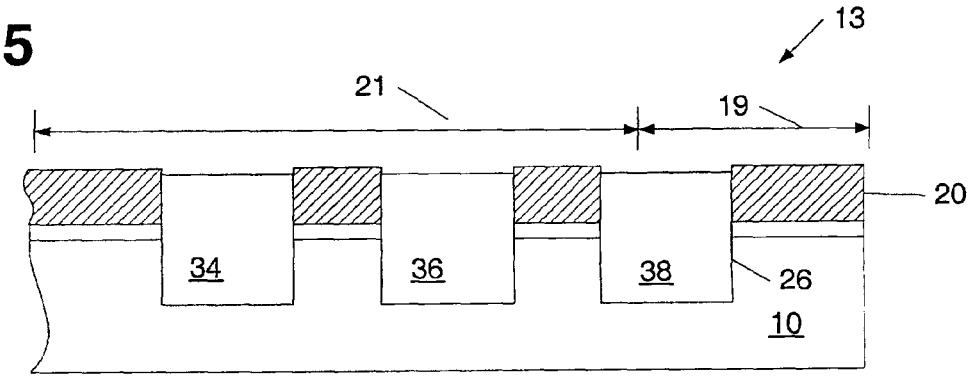
FIG. 5 depicts a partial cross-sectional view of the semiconductor topography of FIG. 6 subsequent to polishing the fill layer.

An exemplary embodiment of the method for processing a semiconductor topography using the polishing system described herein is shown in FIGS. 4 and 5. More specifically, FIG. 4 depicts semiconductor topography 13 in which fill layer 12 is formed upon upper surfaces of polish stop layer 20 and within trenches 26. In addition, polish stop layer 20 is formed upon and in contact with oxide layer 18, which is formed upon and in contact with semiconductor layer 10. Each of the three layers comprises the sidewalls of trenches 26. In addition, lateral surface 14 of the semiconductor topography is drawn to indicate the continuation of the semiconductor topography toward a center portion of the semiconductor topography. On the contrary, lateral surface 16 of the semiconductor topography is drawn to indicate the outer edge of the semiconductor topography. It is noted that several topographical configurations may be used with the polishing system described herein. As such, semiconductor topography 13 in FIGS. 4 and 5 are merely shown as an exemplary embodiment. In particular, the composition, thickness, number, and arrangement of layers within a semiconductor topography used with the polishing system described herein may differ from those described in FIGS. 4 and 5. For example, the polishing system described herein may be used to polish a topography with a substantially planar topography as well as a topography with a substantially non-planar topography as shown in FIG. 4.

The composition of semiconductor layer 10, oxide layer 18, and polish stoop layer 20 may include materials used in the semiconductor fabrication industry. For example, semiconductor layer 10 may be a silicon substrate, and may in some embodiments be doped either n-type (for producing a p-channel transistor) or p-type (for an n-channel transistor). Alternatively, semiconductor layer 10 may include structures and layers formed upon a semiconductor substrate. The structures and layers may include, but are not limited to, gate dielectric layers, gate structures, contact structures, local interconnect wires, additional dielectric layers, or metallization layers. In some cases, diffusion regions may also be formed in semiconductor layer 10. In contrast, oxide layer 18 may include a dielectric layer, such as silicon dioxide ($SiO_2$), tetraorthosilicate glass (TEOS), or silicon dioxide/silicon nitride/silicon dioxide (ONO). In some embodiments, oxide layer 18 may aid in the adhesion of polish stop layer 20 to semiconductor layer 10. In addition, oxide layer 18 may serve as a "pad oxide" to reduce inherent stresses between polish stop layer 20 and a semiconductor layer 10. Alternatively, polish stop layer 20 may be formed upon semiconductor layer 10 without oxide layer 18. In general, polish stop layer 20 may serve as a stop layer for polishing processes as described herein. In this manner, the polishing of overlying layers may be substantially terminated upon exposing polish stop layer 20. As such, appropriate materials for polish stop layer 20 may include any material having a substantially different polish response than fill layer 12.

In general, trenches 26 may be used to form a variety of semiconductor structures. For example, trenches 26 may be used to form contacts or shallow trench isolation regions. In an alternative embodiment, trenches 26 may be omitted from semiconductor topography 13. In such an embodiment, semiconductor topography 13 may include a substantially planar upper surface formed above polishing layer 20, oxide layer 18, and semiconductor layer 10. The polishing process may be used to reduce the thickness of semiconductor topography 13 in such an embodiment. Although FIG. 4 illustrates three trenches across the illustrated portion of semiconductor topography 13, any number of trenches may be formed across the semiconductor topography in accordance with design specifications of the device. In addition, the scale of trenches 26 in relation to the other portions of semiconductor topography 13 is greatly exaggerated to emphasize the planarity of the topography as a result of a subsequent polishing process as shown in FIG. 5. In general, the lateral dimensions of such trenches may be on the order of thousands of angstroms or a few microns. The lateral dimension of the topography shown in FIGS. 4 and 5, on the other hand, may be several centimeters. As such, semiconductor topography 13 may include several trenches within the region extending from the edge of the semiconductor topography. In addition, various widths and depths of the trenches a) may be formed in accordance with the design specifications of the device.

Fill layer 12 may be deposited conformally and thus, may have a non-planar upper surface as shown in FIG. 5. Alternatively, fill layer 12 may be relatively planar if the underlying structures and layers are substantially planar. In either embodiment, the thickness of fill layer 12 may be between approximately 3,000 angstroms and approximately 10,000 angstroms. A larger or smaller thickness of fill layer 12, however, may be appropriate depending on the semiconductor device being formed. The planarity of the upper surface of semiconductor topography 13 may be defined by the thickness variation of the upper layer across the entirety of the semiconductor topography with respect to an underlying plane within the topography. On the other hand, the planarity of the upper surface of semiconductor topography 13 may be determined by comparing an average thickness of structures arranged in one region of the semiconductor topography as compared to the average thickness of similar structures in another region of the semiconductor topography.

In general, fill layer 12 may include any of various layers used in semiconductor fabrication. For example, fill layer 12 may include a conductive material, such as polysilicon, aluminum, copper, titanium, tungsten, or a metal alloy thereof. Alternatively, fill layer 12 may include a dielectric, such as silicon dioxide ($SiO_2$), tetraorthosilicate glass (TEOS), silicon nitride ($Si_xN_y$), silicon oxynitride ($SiO_xN_y(H_z)$), or silicon dioxide/silicon nitride/silicon dioxide (ONO). Fill layer 12 may also be formed from a low-permittivity ("low-k") dielectric, generally known in the art as a dielectric having a dielectric constant of less than about 3.5. One low-k dielectric in current use is fluorine-doped silicon dioxide. In another embodiment, fill layer 12 may be formed from a high-permittivity ("high-k") dielectric, such as tantalum pentoxide ($Ta_2O_5$), barium titanate ($BaTiO_3$), and titanium oxide ($TiO_2$). In any embodiment, fill layer 12 may be undoped or may be doped. Consequently, fill layer 12 may include, for example, low doped borophosphorus silicate glass (BPSG), low doped phosphorus silicate glass (PSG), or fluorinated silicate glass (FSG).

FIG. 5 illustrates semiconductor topography 13 subsequent to the polishing fill layer 12. In particular, FIG. 5 illustrates a substantially planar upper surface of polished topography 13 subsequent to using the polishing process of the polishing system as described herein. More specifically, semiconductor topography 13 is shown with a substantially planar surface within center region 21 and outer edge region 19. In general, center region 21 may include a center portion of semiconductor topography 13 extending to the adjacent boundary of outer edge region 19. On the other hand, outer edge region 19 may include a region of semiconductor topography 13 extending from the boundary of center region 21 to the outer edge of semiconductor topography 13. In some cases, outer edge region 19 may include a region extending less than approximately 25 mm from the edge of semiconductor topography 13, or more specifically less than approximately 8 mm from the edge of semiconductor topography 13. In some embodiments, outer edge region 19 may include a region extending less than approximately 5 mm from the edge of semiconductor topography 13.

In some embodiments, fill layer 12 may be polished to form structures 34, 36, and 38 as shown in FIG. 5. In such an embodiment, the polishing process may include exposing an upper surface of polish stop layer 20 such that structures 34, 36, and 38 may be of substantially uniform elevation with polish stop layer 20 subsequent to the polishing process. In addition, structures 34, 36, and 38 may be formed such that the thickness of a structure arranged within outer edge region 19 may differ by less than approximately 10% from a thickness of a corresponding structure arranged within center region 21. For example, the thickness of structure 38 may differ by less than approximately 10% from the thickness of structures 34 or 36. In another embodiment, the thickness of a structure arranged within outer edge region 19 may differ by less than approximately 5% from a thickness of a corresponding structure arranged within center region 21. In any embodiment, semiconductor topography 13 may be subjected to further processing subsequent to the formation of structures 34, 36, and 38. For example, portions of polish stop layer 20 and/or oxide 18 may be removed subsequent to the polishing process.

The polishing system described herein may be further adapted to produce a substantially constant polishing rate across a semiconductor topography. In particular, a polishing system with a boltless wafer carrier assembly may facilitate a more uniform polishing rate across a semiconductor topography than a conventional polishing system which uses bolts to assemble a wafer carrier. More specifically, the polishing system described herein may produce a smaller polishing rate variation across the topography than conventional systems, particularly at the outer edge of the semiconductor topography. In particular, the polishing system described herein may facilitate a polishing rate variation of less than approximately 5% across a semiconductor topography. More specifically, the polishing system described herein may facilitate a polishing rate variation of less than approximately 5% within an outer edge region of the semiconductor topography.

Figure 6:
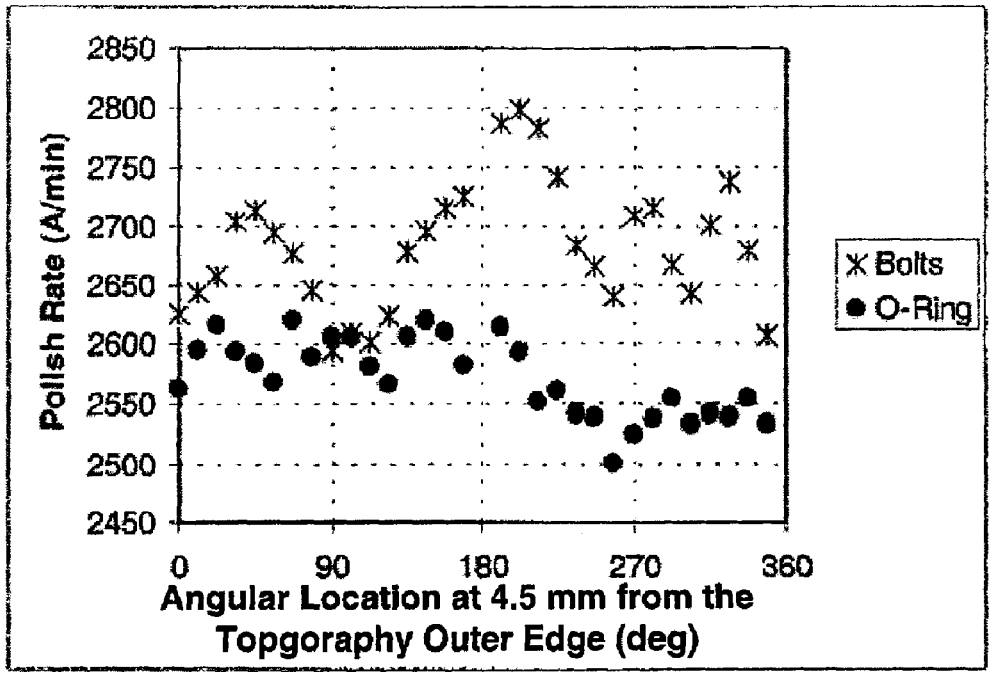
FIG. 6 depicts a graph comparing the polishing rates of a polishing process that includes a wafer carrier assembled through the use of bolts and a polishing process that includes a wafer carrier assembled through the use of an o-ring.

A graph comparing the polishing rates of the polishing system described herein and a polishing system with a wafer carrier assembled using bolts is illustrated in FIG. 6. In particular, FIG. 6 illustrates the polishing rates of two polishing systems in an exemplary embodiment at approximately 4.5 mm from the outer edge of a topography. More specifically, the angular positions along the x-axis of the graph denote positions of the semiconductor topography with respect to a specified position of 0 degrees along a circular boundary extending approximately 4.5 mm from the outer edge of the topography. Such a boundary is used as a reference point only and therefore, is not to be interpreted to be structurally different from the rest of the topography. Consequently, the topography at such a boundary is not necessary distinct from the rest of the topography across the wafer.

As shown in FIG. 6, the polishing rate of a polishing system including a bolted wafer carrier varies between approximately 2600 angstroms/minute and approximately 2800 angstroms/minute across the topography, yielding nearly a 7.5% polishing rate variation. In contrast, the polishing rate of the same material using a polishing system with a wafer carrier assembled using an o-ring varies between approximately 2500 angstroms/minute and approximately 2625 angstroms/minute, yielding less than a 5% variation. As a result, the polishing system described herein may facilitate a 33% improvement in surface planarity in regions extending from the outer edge of a semiconductor topography, and more particularly in regions extending less than approximately 5 mm from the outer edge of a semiconductor topography. In some cases, the polishing system described herein may facilitate a 50% improvement in surface planarity across a semiconductor topography, particularly in regions extending from the outer edge of the topography.

As stated above, the ability of a polishing system to produce a substantially planar topography may alternatively be measured by the amount of the polished layer that remains as the upper surface of a polished topography. For example, the thickness variation of a layer across a topography, which has been polished by the polishing system described herein, may be less than approximately 10%. Moreover, the thickness variation of a layer across a topography, which has been polished by the polishing system described herein, may be less than approximately 5%. For example, the residual thickness of a layer polished by a polishing system using an o-ring to assemble a wafer carrier may vary between approximately 57 angstroms and 60 angstroms across a topography in an embodiment, yielding less than a 5% thickness variation. On the contrary, however, a conventional polishing process, which includes a bolted wafer carrier assembly, may produce a layer with a residual thickness between approximately 70 angstroms and approximately 115 angstroms in an embodiment using similar process parameters. Such a process yields nearly a 60% variation in residual thickness.

The ability of the polishing system described herein to planarize a semiconductor topography may be attributed to the boltless assembly of the wafer carrier holding the semiconductor topography. More specifically, the boltless assembly of the wafer carrier may compensate for the upper layer non-uniformity that is usually formed with conventional polishing processes. In particular, such an assembly of a wafer carrier may compensate for the upper layer non-uniformity in a region adjacent to the outer edge of the topography. In this manner, a substantially planar surface may be obtained across the topography including the center and extending to a region adjacent to the outer edge of the topography when using the polishing system described herein. Consequently, a larger area that is capable of producing a target yield of semiconductor devices within dimensional specifications of the semiconductor topography may be formed with a system that has a wafer carrier assembled with an o-ring rather than bolts. The target yield region of a semiconductor topography may represent the area of the topography that is substantially planar subsequent to the polishing process. In particular, the target yield region may represent the area of the topography in which a specific target yield of semiconductor devices may be suitably fabricated (i.e., within dimensional specifications). Examples of such target yields may be, for example, approximately 85% or approximately 95%. The target yield region mnay extend across a larger area of the topography during the process as described herein than with a process that includes wafer carrier assembled through the use of bolts.

It will be appreciated to those skilled in the art having the benefit of this disclosure that this invention is believed to provide a method for assembling a polishing system and components thereof. Further modifications and alternative embodiments of various aspects of the invention will be apparent to those skilled in the art in view of this description. For example, the methods and systems described herein may be used for any type of polishing applications, including polishing systems not used in the semiconductor industry. Moreover, the polishing system described herein may be used for polishing any structure or layer within a semiconductor topography. In addition, the method and devices described herein may be adapted for wafers of any size (e.g., 6 inch, 8 inch, or 12 inch diameter wafers). It is intended that the following claims be interpreted to embrace all such modifications and changes and, accordingly, the drawings and the specification are to be regarded in an illustrative rather than a restrictive sense.

What is claimed is:

1. A polishing system, comprising:

a carrier plate dimensioned to receive a semiconductor wafer;

a carrier ring dimensioned to hold the semiconductor wafer relative to the carrier plate; and an o-ring dimensioned to couple the carrier ring to the carrier plate such that sidewalls of the carrier ring and carrier plate are in contact, wherein the carrier plate and the carrier ring each comprise a groove dimensioned to receive a part of the o-ring.

2. The polishing system of claim 1, wherein the carrier ring and the carrier plate are dimensioned to protrude a portion of the semiconductor wafer within approximately 0.001 inches of a predetermine value.

3. The polishing system of claim 2, wherein the carrier ring comprises a thickness tolerance between approximately 0.0001 inches and approximately 0.001 inches.

4. The polishing system of claim 2, wherein the carrier plate comprises a thickness tolerance between approximately 0.0001 inches and approximately 0.001 inches.

5. The polishing system of claim 1, wherein the polishing system is dimensioned adapted to produce a substantially planar surface in a region extending less than approximately 10 mm from an outer edge of the semiconductor wafer, wherein the substantially planar surface comprises a structure with a thickness that differs by less than approximately 10% of a thickness of a similar structure arranged within the center of the semiconductor wafer.

6. The polishing system of claim 1, wherein the carrier plate, carrier ring and o-ring are collectively dimensioned to prevent movement of the carrier ring when the semiconductor wafer is being polished.

7. The polishing system of claim 1, wherein the grooves of the carrier plate and carrier ring are arranged within sidewalls which are substantially perpendicular to a surface of the carrier plate configured to receive the semiconductor wafer.

8. The polishing system of claim 1, wherein the carrier plate comprises an elongated portion and a shortened portion, and wherein the carrier ring is configured to fit flush with surfaces of at least one of the elongated and shortened portions.

9. The polishing system of claim 8, wherein a dimensional variation between elongated portion and shortened portion is substantially similar to a width of the carrier ring.

10. The polishing system of claim 8, wherein the groove on the carrier plate is positioned along the shortened portion.

11. A semiconductor polishing system component comprising a notch dimensioned to receive an o-ring, wherein the semiconductor polishing system component is dimensioned to couple to another semiconductor polishing system component by use of the o-ring, and wherein semiconductor polishing system component is dimensioned to protrude a portion of a semiconductor wafer received and held by the two components.

12. The semiconductor polishing system component of claim 11, wherein the semiconductor polishing system component is dimensioned to protrude the portion of the semiconductor wafer within approximately 0.001 inches of a predetermined value.

13. The semiconductor polishing system component of claim 12, wherein the semiconductor polishing system component is a carrier ring.

14. The semiconductor polishing system component of claim 13, wherein a thickness variation of the carrier ring is between approximately 0.0001 inches and approximately 0.001 inches.

15. The semiconductor polishing system component of claim 12, wherein the semiconductor polishing system component is a carrier plate.

16. The semiconductor polishing system component of claim 15, wherein the carrier plate comprises a section with a thickness variation between approximately 0.0001 inches and approximately 0.001 inches across the entire width of the section.

17. The polishing system of claim 15, wherein the carrier plate comprises an elongated portion and a shortened portion, and wherein the notch is arranged along the shortened portion.

18. A method for assembling a semiconductor polishing system comprising positioning a first component of the semiconductor polishing system against a portion of an o-ring protruding from a groove arranged within a second component of the semiconductor polishing system such that the first component contacts portions of the second component laterally surrounding the groove within the second component and the protrusion of the o-ring is received by a groove arranged within the first component.

19. The method of claim 18, further comprising placing a semiconductor wafer against one of the first and second components directly after the step of positioning.

20. The method of claim 18, wherein the protrusion of the o-ring extends from a sidewall of the second component by a distance between approximately 0.0001 inches and approximately 0.01 inches.

* * * * *

UNITED STATES PATENT AND TRADEMARK OFFICE

CERTIFICATE OF CORRECTION

PATENT NO. : 6,866,571 B1
DATED : March 15, 2005
INVENTOR(S) : Held

It is certified that error appears in the above-identified patent and that said Letters Patent is hereby corrected as shown below:

Title page,
Item [74], *Attorney, Agent, or Firm*, please delete "Mollie R. Lettang" and substitute therefor -- Mollie E. Lettang --.

Column 16,
Line 24, please delete "predetermine" and substitute therefor -- predetermined --.

Signed and Sealed this

Eighteenth Day of October, 2005

JON W. DUDAS
*Director of the United States Patent and Trademark Office*